United States Patent [19]

Kennedy

[11] 4,431,909

[45] Feb. 14, 1984

[54] COUNTER ASSEMBLY

[75] Inventor: Paul L. Kennedy, Meridan, Conn.

[73] Assignee: Veeder Industries Inc., Hartford, Conn.

[21] Appl. No.: 430,720

[22] Filed: Sep. 30, 1982

[51] Int. Cl.[3] ..... G06C 5/02

[52] U.S. Cl. ..... 235/1 D; 235/117 R; 377/92

[58] Field of Search ..... 235/1 R, 1 D, 117 R, 235/139 R, 144 R, 95 R, 96; 377/30, 92

[56] References Cited

U.S. PATENT DOCUMENTS 3,219,268 11/1965 Stolavz ..... 235/1 D 3,580,498 5/1971 LaPointe et al. ..... 235/117 R

*Primary Examiner*—Benjamin R. Fuller

*Attorney, Agent, or Firm*—Prutzman, Kalb, Chilton & Alix

[57] ABSTRACT

An improved counter assembly comprises an electrically operable counter module insert, a transparent viewing crystal, and an outer box-like case which are held together by an improved mechanical arrangement. The outer case is provided with inwardly projecting abutments engageable by the counter module insert for aligning the insert within the case. The counter module insert includes a pair of laterally spaced rearwardly facing shoulders at its front end, and the crystal includes a pair of laterally spaced rearwardly projecting retention fingers engageable with the shoulders of the module insert for retaining the case, crystal and module insert in an assembled relationship. The improved construction provides increased resistance to tampering.

9 Claims, 4 Drawing Figures

COUNTER ASSEMBLY

FIELD OF THE INVENTION

The present invention relates to a counter assembly and, more particularly, to an improved structural arrangement for an electromagnetic counter assembly employing a transparent viewing crystal.

BACKGROUND OF THE INVENTION

The present invention is directed to an improvement in a counter assembly such as the type of electromagnetic counting mechanism disclosed in U.S. Pat. No. 3,580,498, which is assigned to the same assignee as the present application. The counter assembly of the present invention, which for purposes of illustration is described in relation to the electromagnetic counting mechanism of U.S. Pat. No. 3,580,498, comprises an electrically operable counter module insert, a transparent viewing crystal, and an outer box-like case which interlock to provide an improved mechanical assembly. The improved assembly does not require heat setting of the crystal into the case nor is there a requirement of application of epoxy to secure the case to the frame of the module insert. The improved assembly also provides increased resistance to tampering and unauthorized disassembly because disassembly can be readily accomplished only by breaking or destroying the integrity of the crystal.

An important improvement provided by the present invention relates to the latter assembly stages of a counter assembly, such as that exemplified in U.S. Pat. No. 3,580,498, in which the counter module insert, the outer case, and the transparent viewing chrystal are assembled to produce the finished counter assembly.

BRIEF SUMMARY OF THE INVENTION

In a preferred embodiment of the invention, an outer case adapted to receive a counter module insert includes at a front face a recessed crystal receptacle. The outer case is further provided with abutment means engageable by the counter module insert for aligning the insert upon reception within the case. The counter module insert includes at its corresponding front end a pair of laterally spaced rearwardly facing shoulders. A transparent viewing crystal includes a pair of laterally spaced rearwardly projecting retention fingers engageable with the shoulders of the module insert for retaining the case, crystal and module insert in an assembled relationship.

Preferably, the frame of the counter module insert which supports the counter readout wheels includes a pair of opposing side walls provided with a pair of slots which define the rearwardly facing shoulders on the frame. The case includes an opening in its front wall provided with an offset, inwardly extending ledge formed at the perimeter of the opening which defines a crystal receptacle for receiving and supporting the transparent viewing crystal. Each of the shoulders of the frame of the counter module extend adjacent to the forward end of the frame whereby, upon reception in the case of the counter module insert and insertion of the transparent viewing crystal into the crystal receptacle, the retention fingers clamp the forward end of the frame against a portion of the offset ledge to firmly lock the counter module insert, transparent viewing crystal and case in assembled relationship.

It is an object of the present invention to provide a counter assembly in which the counter module insert, transparent viewing crystal, and outer case are interconnected by an improved mechanical construction which firmly retains these components in an assembled relationship.

It is also an object of the invention to provide a counter assembly having an improved, tamper-proof construction.

It is another object of the invention to provide a counter assembly having a transparent viewing crystal the assembly of which does not require heat setting or the application of epoxy.

It is a further object of the invention to provide a low cost counter assembly comprising components which are readily and inexpensively assembled in an efficient manner.

BRIEF DESCRIPTION OF THE DRAWINGS

The accompanying drawings illustrate a preferred embodiment of the invention and together with the description serve to explain the principles and operation of the invention.

In the drawings.

DETAILED DESCRIPTION

Figure 1:
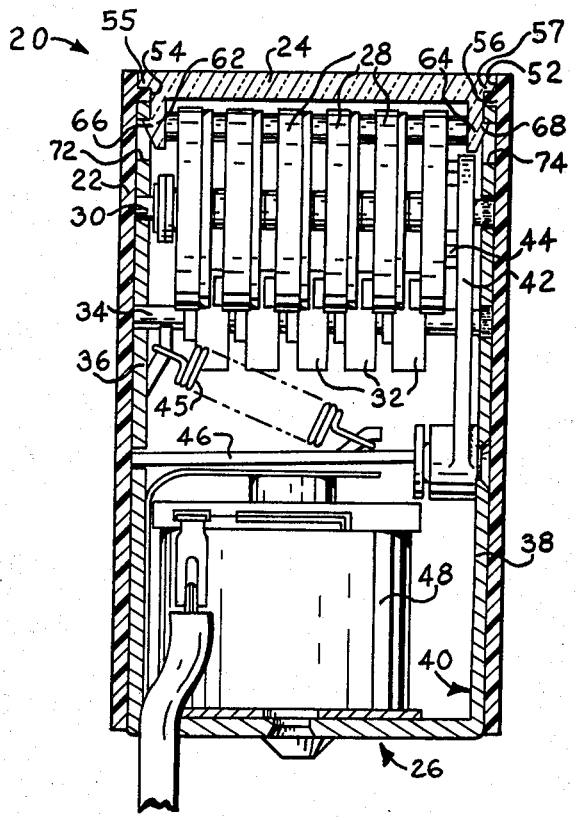
FIG. 1 is a side elevation, partially in section, illustrating the components of an electromagnetic counter assembly embodying the invention.

Referring to FIG. 1, a counter assembly shown, generally as 20, includes an outer case 22, which is generally box-like in shape and preferably made of plastic material, a transparent viewing crystal 24 insertable into a crystal receptacle at the front end of the case, and an electrically operable counter module insert 26 which is receivable in outer case 22 through an opening at the rear end of the case.

Counter module insert 26 may assume a number of forms, but is preferably generally of the same type of construction shown and described in U.S. Pat. No. 3,580,498 assigned to the assignee of the present application. The counter module insert includes a bank of counter readout wheels 28 of ascending order rotatably mounted on a first shaft 30 and located at a front end of the counter module insert. In a conventional manner the counter wheels comprise indicia bearing rims which rotate to align with a readout window to thereby register a count. The counter module also includes a plurality of transfer pinions 32 rotatably mounted on a second shaft 34 for transferring a count from adjacent lower order to higher order wheels. Shafts 30 and 34 are mounted between oppposing side walls 36 and 38 of an inner, box-like frame designated generally as frame 40 which supports the various components of the counter module insert. The counter module insert further includes a verge 42 designed to drive counter wheels 28 via a conventional star wheel 44 and a clapper 46 which is actuated by a solenoid 48 to pivot verge 42 in response to electrical signals applied to the solenoid. A tension spring 45 is provided to return clapper 46 to its normal, unactuated position when solenoid 48 is de-energized. The foregoing components are illustrative of an electromagnetic counter module insert of the type described in U.S. Pat. No. 3,580,498 which type of counter module insert is described for purposes of illustration and is not to be deemed as a limitation of the present invention. For a more detailed description of the components and operation of a preferred counter module insert, reference is made to U.S. Pat. No. 3,580,498.

Figure 2:
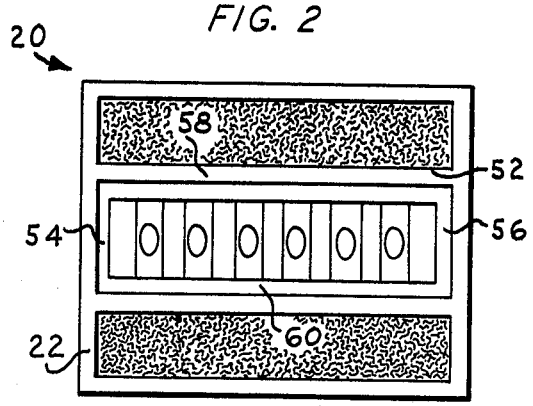
FIG. 2 is a front view of the electromagnetic counter assembly of FIG. 1.
Figure 3:
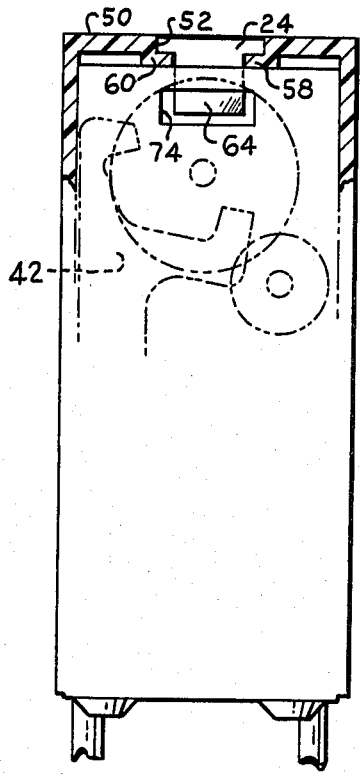
FIG. 3 is a side view, viewed from the right of FIG. 1, partially broken away and partially in phantom, illustrating the electromagnetic counter assembly of FIG. 1.

As shown in FIG. 2, transparent viewing crystal 24 in a preferred form has a generally rectangular portion. Outer case 22 has a front wall 50 provided with a rectangular opening 52 which serves as a crystal receptacle. This crystal receptacle is also defined by an off-set, inwardly extending ledge consisting of four segments 54, 56, 58 and 60 formed at the periphery of opening 52 in the front wall of case 22. As shown in FIG. 1, side ledges 54 and 56 project inwardly from opposing side walls of outer case 22. As shown in FIG. 3, elongated ledges 58 and 60 are offset from front wall 50 of outer case 22. Thus, side ledges 54 and 56 and elongated ledges 58 and 60 provide a recessed crystal receptacle in the front wall of outer case 22 for receiving and supporting transparent viewing crystal 24.

Referring to FIG. 1, transparent viewing crystal 24 comprises an integrated structure which includes a pair of retention fingers 62 and 64 which project rearwardly from positions adjacent to opposite ends of the crystal. Preferably, as shown in FIG. 3 for retention finger 62, each retention finger protrudes from substantially the entire width of crystal 24.

Referring to FIG. 1, which illustrates the counter assembly in assembled form, retention fingers 62 and 64 include outwardly projecting lips 66 and 68, respectively, which project into corresponding slots 72 and 74 formed in opposite side walls 36 and 38 of the inner frame 40. Preferably, as shown in FIG. 3, each slot is rectangular in configuration.

Figure 4:
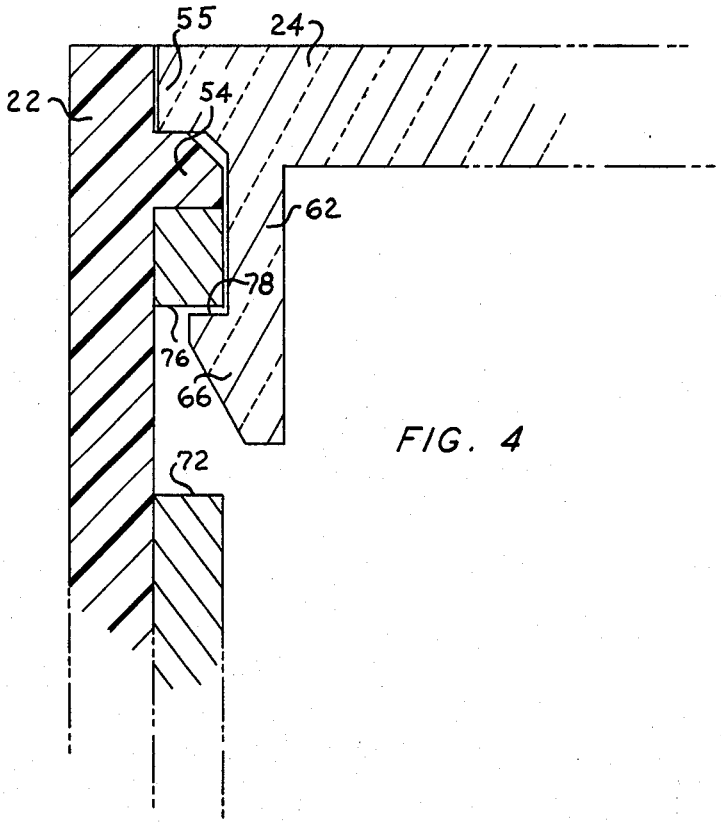
FIG. 4 is an enlarged view of a portion of FIG. 1, partially in section.

Referring to FIG. 4, slot 72 defines a rearwardly facing shoulder 76 at the front end of the inner frame which is engageable with a forwardly facing surface 78 provided by outwardly projecting lip 66. Retention finger 64 and slot 74 are substantially identical in construction to retention finger 62 and slot 72. Retention fingers 62 and 64 engage the rearwardly facing shoulders provided by slots 72 and 74, respectively, to interlock together the outer case, the counter module insert, and the transparent viewing crystal.

Referring to FIGS. 1 and 4, viewing crystal 24 is further provided with tabs 55 and 57 adjacent the retention fingers 62 and 64, respectively, which bear against ledges 54 and 56, respectively, to complete the interlocking between the outer case, the counter module insert and the transparent viewing crystal. As illustrated in FIG. 4, the distance from tab 55 to the corresponding surface 78 is substantially commensurate with the vertical thickness of ledge 54 and shoulder 76.

The electromagnetic counter assembly is efficiently assembled as follows. First, counter module insert 26 is inserted into outer case 22. The inner frame of the counter module is moved upwardly into outer case 22 until the front ends of frame side walls 36 and 38 abut inwardly projecting ledges 54 and 56 on the outer case. Ledges 54 and 56 serve as abutment means for aligning the counter module insert within the case. Next, transparent viewing crystal 24 is inserted into the rectangular opening or crystal receptacle 52 at the front end of outer case 22 and the crystal is snapped into place. Viewing crystal 24 is constructed of a resilient material which is sufficiently resilient to permit retention fingers 62 and 64 to bend inwardly during insertion and allow outwardly projecting lips 66 and 68 to pass by inwardly projecting ledges 54 and 56 and the portions of frame side walls 36 and 38 located in front of slots 72 and 74. When the insertion of the transparent viewing crystal into the crystal receptacle is substantially complete, i.e., tabs 55 and 57 contact ledges 54 and 56, retention fingers 62 and 64 snap into place within slots 72 and 74, respectively, so that outwardly projecting lips 66 and 68 engage the rearwardly facing shoulders provided by slots 72 and 74 to firmly interlock the counter assembly components.

The preferred embodiment of the electromagnetic counter assembly provides an essentially tamper-proof construction. Once the transparent viewing crystal is snapped into place, the counter assembly cannot be readily disassembled without breaking or damaging the viewing crystal. In an alternate embodiment (not shown), the counter assembly may be designed to permit disassembly by provision of an opening in outer case 22. The opening is aligned with one of the slots 72 or 74 in the inner frame to provide access to one of the retention fingers 62 or 64 to force the disengagement of a retention finger from the shoulder provided by its corresponding slot and thus permit disassembly of the counter assembly.

While the invention herein has been described in conjunction with specific embodiments, it is evident that many alternatives, modifications and variations will be apparent to those skilled in the art. Accordingly, the invention is intended to embrace all alternatives, modifications, and variations that fall within the spirit and scope of the appended claims.

What is claimed is:

1. In a counter assembly of the type having a counter module insert including a bank of counter readout wheels at a front end thereof for registering a count, a transparent viewing crystal for viewing the counter wheel readout, an outer case having an opening at a rear end for receiving the counter module insert and having a crystal receptacle at a front end thereof for mounting the viewing crystal, the improvement wherein the outer case has abutment means engageable by the counter module insert for aligning the insert within the case, the counter module insert at the front end thereof has a pair of laterally spaced rearwardly facing shoulders, and the crystal has a pair of laterally spaced rearwardly projecting retention fingers engageable with the shoulders of the module insert for retaining the case, crystal and module insert in assembled relationship.

2. The counter assembly of claim 1, wherein said counter module insert includes an inner frame of generally box-like shape for supporting said counter readout wheels, said frame having a pair of opposing side walls provided with a pair of slots which form said rearwardly facing shoulders.

3. The counter assembly of claim 2, wherein each of said slots is adjacent to a forward end of said inner frame whereby when said transparent viewing crystal is inserted into said crystal receptacle, said retention fingers clamp the forward end of said frame against said abutment means.

4. The counter assembly of claim 2, wherein each of said retention fingers includes an outwardly projecting lip provided with a forwardly facing surface engageable with a rearwardly projecting shoulder to provide engagement between said crystal, outer case and inner frame.

5. The counter assembly of claim 1, wherein said outer case includes a front wall provided with an opening for receiving said transparent viewing crystal and having an offset, inwardly extending peripheral ledge at the perimeter of said opening for receiving and supporting said transparent viewing crystal.

6. The counter assembly of claim 5, wherein said abutment means comprises a portion of said peripheral ledge, said ledge portion abuttable against the front end of said inner frame.

7. The counter assembly of claim 2, wherein said transparent viewing crystal has a generally rectangular portion from which said retention fingers project rearwardly from positions adjacent to opposite ends of said crystal.

8. The counter assembly of claim 7, wherein each of said retention fingers protrude from substantially the entire width of said crystal.

9. The counter assembly of claim 4 wherein the crystal further comprises a tab at each end adjacent said resilient fingers, the distance between each of said tabs and its corresponding forward facing surface is commensurate with the thickness of the abutment means and the counter module insert shoulder.

* * * * *